US007124613B1

(12) United States Patent
McClung

(10) Patent No.: US 7,124,613 B1
(45) Date of Patent: Oct. 24, 2006

(54) PRESS AND METHOD OF MANUFACTURING A CAN END

(75) Inventor: James A. McClung, Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 11/191,354

(22) Filed: Jul. 28, 2005

(51) Int. Cl.
*B21D 22/00* (2006.01)

(52) U.S. Cl. ..... 72/348; 72/379.4

(58) Field of Classification Search ..... 72/347, 72/349, 379.4, 348
See application file for complete search history.

(56) References Cited

U.S. PATENT DOCUMENTS

| | | | | |
|---|---|---|---|---|
| 4,372,143 | A | 2/1983 | Elert et al. | |
| 4,685,322 | A | 8/1987 | Clowes | |
| 4,723,433 | A | 2/1988 | Grims | |
| 4,732,031 | A | 3/1988 | Bulso, Jr. et al. | |
| 4,790,169 | A | 12/1988 | Johansson et al. | |
| 4,989,434 | A | 2/1991 | Brossia et al. | |
| 5,111,679 | A | 5/1992 | Kobayashi et al. | |
| 5,125,257 | A | 6/1992 | Worwag et al. | |
| 5,154,075 | A | 10/1992 | Hahn et al. | |
| 5,272,902 | A | 12/1993 | Kobak | |
| 5,301,534 | A | 4/1994 | Nishikawa et al. | |
| 5,394,727 | A | 3/1995 | Diekhoff et al. | |
| 5,487,295 | A | 1/1996 | Diekhoff et al. | |
| 5,522,248 | A | 6/1996 | Diekhoff et al. | |
| 5,797,292 | A | 8/1998 | Johansson et al. | |
| 5,881,593 | A | 3/1999 | Bulso, Jr. et al. | |
| 6,070,447 | A | 6/2000 | Bone et al. | |
| 6,490,904 | B1 | 12/2002 | Zauhar | |
| 6,830,419 | B1 * | 12/2004 | Turner et al. | 413/8 |
| 7,000,445 | B1 * | 2/2006 | Hepner et al. | 72/349 |

* cited by examiner

*Primary Examiner*—Lowell A. Larson
*Assistant Examiner*—Debra Wolfe
(74) *Attorney, Agent, or Firm*—David P. Maivald; Eckert Seamans Cherin & Mellott, LLC

(57) ABSTRACT

An apparatus and method for forming a can end having an annular ridge and a central panel and a can body with a can bottom is provided that exhibits reduced wrinkling in the material used to form the can end and can body. The method of the invention uses a two step doming process wherein material is first drawn or stretched and then held by a punch core ring and then further drawn, stretched or domed and then held by a punch core. The apparatus and method of the invention also include a lower piston located above an upper pressure sleeve and radially outward from a punch core ring wherein the lower piston has a bore and the lower piston, punch core ring and upper pressure sleeve define a gap to which pressurized gas may be supplied through the bore to selectively axially actuate the punch core ring.

17 Claims, 9 Drawing Sheets

PRESS AND METHOD OF MANUFACTURING A CAN END

FIELD OF THE INVENTION

The present invention generally relates to an apparatus and method for forming can bodies or container end panels, commonly called can ends, from a sheet of material. More particularly, the present invention relates to an apparatus and method for forming can bodies or container end panels, commonly used for the bottom of cans, wherein the can bodies or can ends exhibit reduced wrinkling.

BACKGROUND OF THE INVENTION

It is well known to draw and iron a sheet metal blank to make a thin walled can body for packaging carbonated beverages, non-carbonated beverages, food or other substances within the can body. In a conventional can body, a bottom profile of the can body includes an outwardly protruding annular ridge near the periphery of the can body, and a slope inwardly from the annular ridge that forms an inwardly projecting dome portion of the can body, called a domed can end.

In a two-piece can, the dome would be formed directly into the bottom of the can body with the dome integrally connected to the drawn and/or ironed sidewalls of the can body. The can is completed by seaming a can end or affixing a closure on the top of the can body for sealing the contents of the can body.

In a three-piece can, the dome would be formed in a can end. The domed can end is then seamed onto the bottom of the can body. Like the two-piece can, the three-piece can is completed by seaming a can end or affixing a closure on the top of the can body for sealing the contents of the can body.

Domed can ends significantly increase the strength of the bottom of a can body. This allows manufacturers to reduce the amount of metal used in the domed can end without sacrificing strength. Additional advantages of doming includes an increased ability to stack cans on top of each other when a domed can end is present on the can body.

Several prior U.S. patents disclose apparatus and methods wherein domed can bodies are formed. These patents generally disclose apparatuses with a curved, convex punch core and a concave die core, such that a domed can body is formed from material conveyed between the punch core and the die core. Typically, the punch core extends downward into the die core, forming the domed can body. These patents, however, generally include a single action of pushing the punch core into the die core. Representative patents include U.S. Pat. No. 6,070,447 to Bone et al., U.S. Pat. No. 5,154,075 to Hahn et al., and U.S. Pat. No. 4,723,433 to Grims.

There continues to be a need in the art for forming domed can bodies and can ends that are substantially free from wrinkles that are formed during drawing and doming. Wrinkles can cause problems in the finishes in the dome of the can body and/or can end, for example, by causing cracks in the epoxy placed on the can body and/or can end. Several patents disclose methods and apparatus to overcome these wrinkles. For example, U.S. Pat. No. 4,685,322 to Cloves discloses a method for reducing wrinkling by forming an upwardly projecting annular bead in a bottom wall of a cup that is subsequently redrawn into a can body. U.S. Pat. No. 4,372,143 to Elert et al. discloses a method wherein a blank is preformed into a cup and thereafter is held in place by pressure sleeves on a die core while the inwardly projecting domed surface is formed by the die core. U.S. Pat. No. 5,394,727 to Diekhoff et al. discloses a method that includes the steps of forming a blanked sheet into a cup, forming a recessed boss into the base of the cup, redrawing the cup into a redrawn cup, and ironing and reforming the redrawn cup into a can body. Wrinkling is reduced by controlling the metal flow during the redraw until a lower body radius and a redraw radius are approximately tangent.

These wrinkling-decreasing techniques utilize multiple steps to shape and redraw the material prior to forming the domed shape in the material and form the dome by utilizing a single convex domed-shaped forming tool entering into a corresponding concave tool. As such, room remains in the art for an alternative dome forming method and apparatus that does not unduly strain the material being formed into a domed can end or can body.

SUMMARY OF THE INVENTION

Accordingly, an object of the present invention is to provide a method and apparatus for forming a can end or can body from material that substantially reduces wrinkling in the can end or can body.

A method for forming a domed can end from material in a doming press assembly, in an apparatus with one or a multiplicity of doming press assemblies is provided. The method comprises the following steps: i) moving the material into the assembly between a set of upper toolings and a set of lower toolings; ii) providing the material with a first surface connected to a second surface; iii) holding the material at a radially outward area of the second surface; iv) drawing or stretching the material located radially inwardly from the connection of the first surface and the second surface and radially outwardly from an axis that passes through a center of the second surface of the material; v) holding the drawn or stretched material at the location of the material that was drawn or stretched in step iv) in a pressure relationship; vi) drawing, stretching or doming the material located radially inwardly from the location of the material drawn or stretched in step iv); and vii) holding the drawn, stretched or domed material at the location of the material that was drawn, stretched or domed in step vi) in a pressure relationship.

An apparatus for forming a domed can end from material in a doming press assembly is provided. The apparatus has a punch core, a punch core ring concentrically disposed around the punch core and located radially outward from the punch core, and an upper pressure sleeve concentrically disposed around the punch core ring and located radially outward from the punch core ring. The apparatus also has a die core located in opposed relationship to the punch core and the punch core ring, a die core ring concentrically disposed around the die core and located radially outward from the die core in opposed relationship to the upper pressure sleeve. The upper pressure sleeve and the die core ring are structured to hold material having a first surface and a second surface therebetween at a radially outward extent of the second surface. The punch core ring is also selectively axially actuable and is structured to draw the material located radially inwardly from the connection of the first surface and the second surface and radially outwardly from an axis that passes through a center of the second surface of the material, and the punch core ring and the die core ring are structured to hold the material located radially inwardly from the connection of the first surface and the second surface and radially outwardly from the axis. The punch core is additionally structured to draw the material located radially inwardly from the material that would be drawn by the punch core ring, and the punch core and the die core are structured to hold the material located radially inwardly from the material that would be drawn by the punch core ring.

An apparatus for forming a can end from material in a press assembly is provided. The apparatus has a punch core, a punch core ring concentrically disposed around the punch core and located radially outward from the punch core and an upper pressure sleeve concentrically disposed around the punch core ring and located radially outward from the punch core ring. The apparatus also has a die core located in opposed relationship to the punch core and the punch core ring, a die core ring concentrically disposed around the die core and located radially outward from the die core in opposed relationship to the upper pressure sleeve and a lower piston located above the upper pressure sleeve and radially outward from the punch core ring. The lower piston has a bore and the lower piston, punch core ring and upper pressure sleeve define a gap to which pressurized gas may be supplied through the bore to selectively axially actuate the punch core ring.

This object of the invention will be more fully understood from the following detailed description of the invention with reference to the FIGS. appended hereto.

BRIEF DESCRIPTION OF THE PREFERRED EMBODIMENTS

Figure 1:
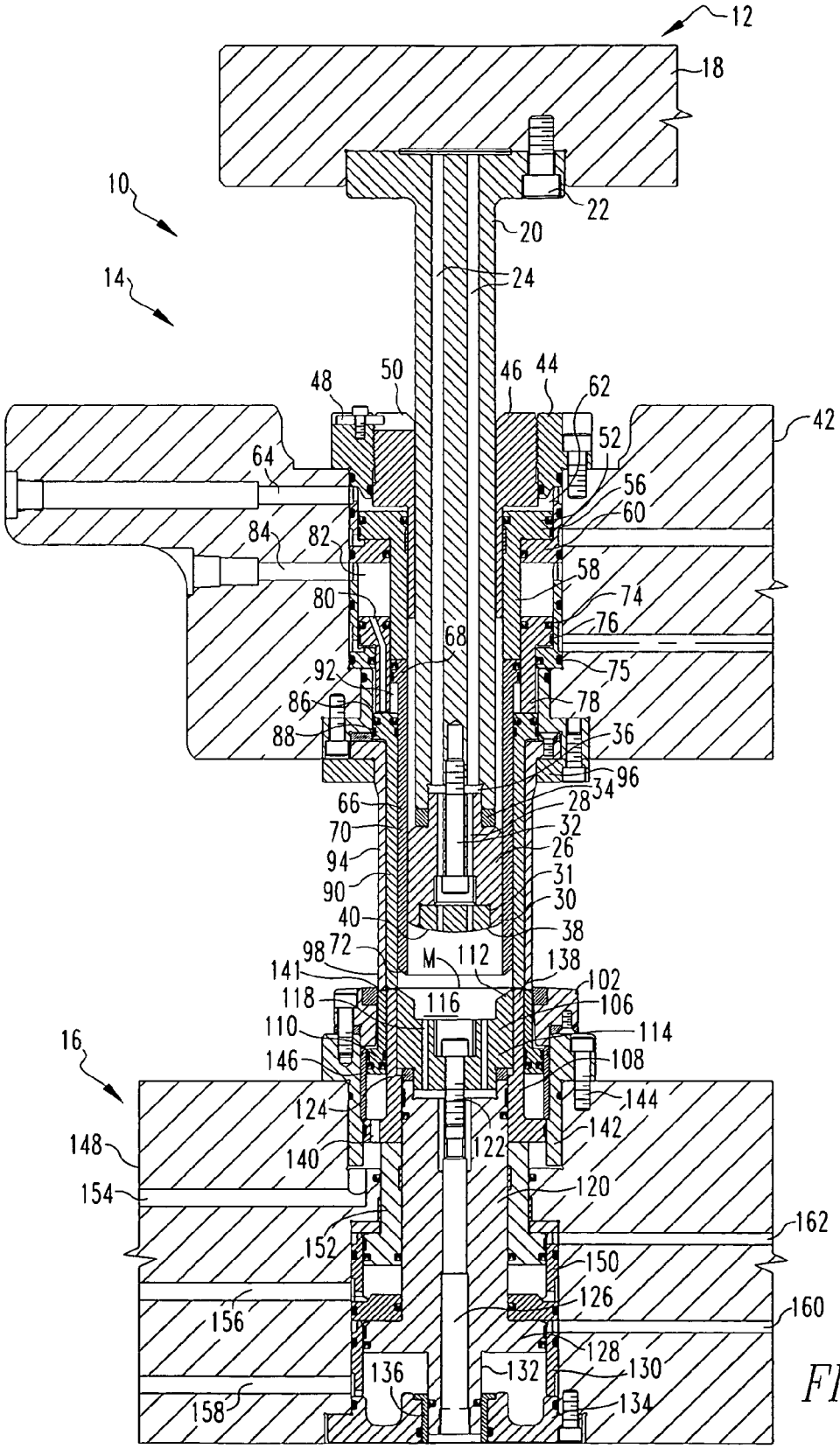
FIG. 1 is cross-sectional view of a double action doming press assembly showing a punch shell blanking material M against a cut edge.

For purposes of the description hereinafter, the terms "upper", "lower", "vertical", "horizontal", "top", "bottom", "aft", "behind", and derivatives thereof shall relate to the invention, as it is oriented in the drawing FIGS. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

As employed herein, the term "number" refers to one or more than one (i.e., a plurality). As employed herein, the term "fastener" refers to any suitable fastening, connecting or tightening mechanism expressly including, but not limited to, integral rivets. As employed herein, the statement that two or more parts are "coupled" together shall mean that the parts are joined together either directly or joined through one ore more intermediate parts. As employed herein, the term "pressure relationship" refers to at least two parts such that one or both parts exert pressure on the other, with a medium, for example, a metal sheet, in-between the two parts, whereby the medium is held secure or formed by the two parts.

While the disclosure of the present invention is directed to an apparatus and method for forming domes in a can end to be seamed onto the bottom of a three-piece can, one of ordinary skill in the art would readily appreciate that the teachings of the present invention would equally apply to two-piece cans and the formation of domes in the bottom of a can body. As such, the present invention encompasses an apparatus and method for forming domes into the bottom of a can body as well as for forming domes in a can end it being noted that the details of a press for forming domes into the bottom of a can body has been omitted for the purpose of simplifying the specification and FIGS. of the present invention. Since the present invention would be equally applicable for the purpose of forming domes into the bottom of a can body, a domed can body of a two-piece can is an equivalent to a domed can end of a three-piece can. Reference to a domed can end throughout the specification means a domed can end or a domed can body.

Turning to FIG. 1, one embodiment of the invention, a double action doming press assembly, is shown. The double action doming press assembly, generally indicated by the number 10, is typically located within a doming press formation machine. It should be understood that doming press assembly 10 may be one of a multiplicity of assemblies mounted within a single machine. 12, 24 or any number of doming press assemblies 10 may be mounted within a large housing that makes up the structure of the doming press machine, wherein assemblies are mounted on one or more rams that are lowered and raised in an axial direction relative to the stationary housing.

Doming press assembly 10 generally includes three sections, an inner punch holder 12, an outer punch holder 14, and a die holder 16. Material M is conveyed between punch holders 12 and 14 and die holder 16 by any known means. The operative ends of the punch holders 12, 14 and die holder 16 carry the necessary tooling for the formation of a domed can end from material M. Inner punch holder 12 generally relates to the machinery and toolings along an upper central axis of the assembly that may be axially lowered and raised toward and away from the die holder 16 through axial movement of an inner ram 18. An upper riser 20 of inner punch holder 12 is coupled to inner ram 18 by fastener 22 or other coupling means known in the art. Within the interior of riser 20 extends one or more inner bores 24 that extend through the interior of the riser 20 from an upper end of the riser 20 to a lower end of the riser 20, such that gas can pass completely through in order to remove the domed can end from a punch core 26 after the domed can end has been formed.

Punch core 26 is coupled to riser 20 in operable relation, such that axial movement of the riser 20 results in like movement in the punch core 26. Punch core 26 includes one or more bores 28 that extend through the interior of the punch core 26 from an upper end to a lower end, and further includes a concentric lower surface 30 that is contoured to provide part of the desired domed curvature to material M when the material M is formed. Recess 31 is cut into punch core 26 for receiving punch core domer 38.

Punch core 26 is fastened to upper riser 20 by fastener 32. In one embodiment, the lower surface of the upper riser 20 and the upper surface of the punch core 26 do not touch when the assembly is in a static state. Separating the punch core 26 and the upper riser 20 are spacers 34 and gap 36. As a result of gap 36, bores 28 and bores 24 are arranged such that gas can travel from the inner bores 24 to the bores 28 through gap 36.

Punch core domer 38 is coupled to the punch core 26 within recess 31 such that a lower surface 40 of the punch core domer 38 smoothly continues the lower surface 30 of punch core 26, forming a rounded, convex lower surface that is contoured to provide the desired domed curvature to material M when the material is drawn, stretched or domed.

Outer punch holder 14 generally relates to the machinery and toolings coupled to and manipulated by an outer ram 42, concentrically located outside the punch core 26 and riser 20. The outer punch holder 14 can be axially lowered and raised toward and away from die holder 16 through axial movement of the outer ram 42.

An upper cylinder cap 44, an internal punch shell retainer 46 and a threaded sleeve 50 form a concentric surface around the riser 20. Upper cylinder cap 44 is received between the outer ram 42 and the internal punch shell retainer 46 and is fastened to a key 48 by a fastener. The key 48 is in turn coupled to a threaded sleeve 50. The threaded sleeve 50 lays on top of the internal punch shell retainer 46 for a portion of the upper surface. The upper cylinder cap 44 may further be coupled to the outer ram 42 by a fastener. Internal punch shell retainer 46 includes a lower flange that extends along the exterior surface of the riser 20.

An upper piston 52 is received in a space between the internal punch shell retainer 46 and an upper cylinder 60. Upper piston 52 is generally an inverted L shape concentrically disposed around the internal punch shell retainer 46 with an upper portion 56 and a lower portion 58. Upper portion 56 generally extends above upper cylinder 60, while lower portion 58 extends downward through the outer punch holder 14 below the level of upper cylinder 60. The upper piston 52 can generally be urged in an axial direction in two different ways. First, if the outer ram 42 moves up and down, the upper piston 52 can move up and down in corresponding relation. Second, the upper piston 52 may be moved downward by the pressure buildup of gas in gap 62. Gas can enter gap 62 through bore 64, potentially moving the upper piston 52 downward if the pressure buildup is enough to overcome any possible opposing pressure on the bottom end of the upper piston 52.

Disposed beneath the upper piston 52, concentrically disposed around the riser 20 and the punch core 26, is a punch core ring 66. Punch core ring 66 is in operable relation to the upper piston 52 such that downward movement of the upper piston 52 results in corresponding downward movement of the punch core ring 66. The punch core ring 66 is typically an elongated inverted L shape with an upper section 68 and a lower section 70 that terminates at a beveled lower end 72. Beveled lower end 72 is generally an angled shape that slopes downward from its concentrically exterior surface to its interior surface. Beveled lower end 72 is shaped such that it can draw, stretch or form material M and subsequently function as a pressure sleeve as is more fully described below.

A lower piston 74 is coupled to a lower cylinder 75 and is concentrically disposed around portions of the upper piston 52 and the punch core ring 66. In one embodiment, the lower piston 74 has an inverse general L shape with an upper portion 76 and a lower portion 78. A lower piston bore 80 extends downward through the lower piston 74 from a top surface of the lower piston 74 to a bottom surface of the lower piston 74.

Framed within an open space of the upper cylinder 60, upper piston 52 and lower piston 74 is gap 82. Gas can enter gap 82 through lower bore 84, potentially moving the lower piston 74 downward if the pressure buildup is enough to overcome opposing pressure acting to push the lower piston 74 upward beneath the lower piston 74.

Disposed beneath lower piston 74 is an upper pressure sleeve 86, comprising an upper portion 88 and a lower flange portion 90 that extends to the operative end of the outer punch holder 14. The upper pressure sleeve 86 is concentrically disposed around the punch core ring 66. Upper pressure sleeve 86 is in operable relation to lower piston 74 such that downward movement of the lower piston 74 results in corresponding downward movement of the upper pressure sleeve 86. The upper pressure sleeve 86 serves to hold the material M secure in cooperation with certain lower wear tools while other toolings of the assembly form a blank of material M into a domed can end.

Framed within the open space by the upper portion 88 of the upper pressure sleeve 86, the lower portion 78 of the lower piston 74, the upper section 68 of the punch core ring 66 and a portion of the lower section 70 of the punch core ring 66 is gap 92. Gas can enter gap 92 through lower piston bore 80 (via bore 84 and gap 82), potentially creating pressure in gap 92. The pressure in gap 92 can act on the upper section 68 of the punch core ring 66 and thereby urge punch core ring 66 in an upwards direction or selectively axially actuate the punch core ring 66. The pressure will move the punch core ring 66 upwards if the pressure buildup is enough to overcome any opposing pressure acting to push the punch core ring 66 downward, i.e., upper piston 52 by way of bore 64 and gap 62.

Concentrically disposed around the upper pressure sleeve 86 is a punch shell 94. The punch shell 94 is firmly coupled to the outer ram 42 by fasteners and/or punch shell clamp 96. As the punch shell 94 is firmly coupled to the outer ram 42, movements of the outer ram 42 in an upward and downward motion in an axial direction will directly move the punch shell 94 in an up and down axial direction without regard to any gas flowing through the bores of the doming press assembly 10. The punch shell 94 includes a long, downwardly extending flange portion that terminates at end 98 along the operative end of the outer punch holder 14. End 98 enables the punch shell 94 to blank the material against cut edge 102, as more fully described below.

Die core holder 16 generally relates to the machinery and toolings attached to lower base 148, wherein an upper surface is an operative end for forming the material M into the desired shape. The operative end of the die core holder 16 includes, most relevantly, die core 106 located in opposed relationship to the punch core 26 and the punch core ring 66, die core ring 108 concentrically disposed around the die core 106 located in opposed relationship to the upper pressure sleeve 86, lower pressure sleeve 110 concentrically disposed around the die core ring 108 located in opposed relationship to the punch shell 94 and the cutedge 102 located radially outwardly from the lower pressure sleeve 110.

Centrally disposed along the operable surface of the die core holder 16 is the die core 106. The die core 106 is located in opposed relationship to the combination of the punch core 26 and the punch core ring 66 of the punch holders. Preferably, the die core 106 is generally U-shaped, with two curved upper prongs 112 that are contoured to provide the desired curvature to material M. For example, the prongs 112 slope downward from a higher, radially outward point to a lower radially inward point, wherein the slope or angle corresponds to the slope or angle of punch core ring 66 and the punch core 26 on the punch holders. Base portion 114 of the die core 106 is integrally formed with and supports prongs 112. The combination of the base portion 114 and the upper prongs 112 define recess 116. Further, bored within the die core 106 are die core bores 118.

The die core 106 is coupled to die core riser 120 by fastener 122. A gap is defined between die core 106 and the die core riser 120 for receiving spacer 124, wherein spacer 124 distances the die core 106 from the die core riser 120. As the die core riser 120 raises and lowers, spacer 124 assists in maintaining a barrier between the die core riser 120 and the die core 106. Central bore 126 is bored within the die core riser 120 in relation to the die core 106, such that gas traveling through bore 126 can move onward through the die core bores 118.

A lower portion of the die core riser 120 includes a radial shelf 128 that extends horizontally towards the base 148. The radial shelf 128 is coupled to the base 148 through lower cylinder 130. A lower protrusion 132 of the lower portion of the die core riser 120 extends downward toward lower cap 134. The lower protrusion 132 is coupled to lower cap 134 though bushing 136. The lower cap 134 is also coupled to the base 148.

Concentrically disposed around the die core 106 is the die core ring 108, generally located opposite to the upper pressure sleeve 86 of the outer punch holder 14. Die core ring 108 is an L-shaped ring with a long, extended upper portion that terminates at beveled top 138. The beveled top 138 is contoured to cooperate with the lower surface of the upper pressure sleeve 86 in holding the material M steady during formation of the domed can end. The die core ring 108 may also include bore 140 that extends through a bottom portion of the die core ring 108.

Radially outward the die core ring 108 and concentrically disposed around the die core ring 108 is a lower pressure sleeve 110 located in opposed relationship to punch shell 94. The lower pressure sleeve 110 is located radially inward of cutedge 102. The combination of cutedge 102 and punch shell 94 serve to blank the material M during the doming process of the can end. The shapes of these toolings are therefore designed to further this goal. The design includes a sharpened edge 141 of cutedge 102 that interacts with the punch shell 94 to blank the material M while the material M is positioned between the bottom of the punch shell 94 and the top of the lower pressure sleeve 110.

Cutedge retainer 142 supports the cutedge 102 and is coupled to the base 148 by fastener 144. The lower pressure sleeve 110 is coupled to the cutedge retainer 142 via liner 146.

Disposed beneath the die core ring 108 is bottom piston 152. The bottom piston 152 is preferably a generally L shaped piston having a lower, thicker portion and a flange that extends upward from the interior side of the thicker portion. The lower and interior portions each share an interior side that is concentrically disposed around the die core riser 120. The lower portion is coupled to upper cylinder 150 on its radially outward side, wherein the upper cylinder 150 is coupled to the base 148. A top portion of the bottom piston 152 comes into operable contact with the die core ring 108, thereby having the ability to urge the die core ring 108 in an axial direction.

The die core holder 16 includes several bores 154, 156 and 158 that can exact pressure on the die core riser 120, the bottom piston 152 or the lower pressure sleeve 110, thereby urging those parts and any tooling components operably connected thereto, if any, axially upward. The gas pressure in the bores 154, 156 and 158 can be increased to an amount that enables movement of the tooling components. Bore 154 is formed below the die core ring 108, below the bottom of the lower pressure sleeve 110 and below the cutedge retainer 142. Bore 156 is formed below a bottom portion of the bottom piston 152. Bore 158 is formed below die core riser 120. Bore 160 is an outlet for gas supplied through bore 158. Likewise, bore 162 is an outlet for gas supplied through bore 156.

The bores 154, 156 and 158 can accept pressurized gas, and supply pressure below the lower pressure sleeve 110, below the bottom piston 152 and below the die core riser 120 respectively. In the present embodiment, bore 154 can receive gas to supply gas through bore 140 to the bottom of the lower pressure sleeve 110 so that the lower pressure sleeve 110 is supported on a column of gas. Bore 156 can receive gas to supply gas to the bottom of the bottom piston 152 which pushes the bottom piston 152 upward and the die core ring 108 in communication with the bottom piston 152 upward. Bore 158 can receive gas to supply gas to the bottom of the die core riser 120 which pushes the die core riser 120 upward and the die core 106 in communication with the die core riser 120 upward. When the die core riser 120 is at its uppermost position, bore 160 bleeds gas from the doming press assembly 10 that was supplied from bore 158. When the bottom piston 152 is at its uppermost position, bore 162 bleeds gas from the doming press assembly 10 that was supplied from bore 156.

Referring to FIGS. 1–9, the operation of the apparatus and method of the present invention is depicted. As shown in FIG. 1, material M has been inserted in the doming press assembly 10 either in sheet form or from a coil of material M, and is interposed between the toolings coupled to the inner and outer punch holders 12, 14 and the die holder 16. The inner and outer punch holder 12, 14 are coupled to several tooling components from radially inward to radially outward: punch core 26 with lower surface 30 and 40 with a rounded, convex shape coupled to the inner punch holder 12, punch core ring 66 with beveled end 72 concentrically disposed around the punch core 26 and coupled to the outer punch holder 14, upper pressure sleeve 86 concentrically disposed around the punch core ring 66 and coupled to the outer punch holder 14, and punch shell 94 concentrically disposed around the upper pressure sleeve 86 and coupled to the outer punch holder 14. These tools can be manipulated in an upward and downward manner by inner or outer rams 18, 42 as discussed above, depending on which ram 18, 42 to which they are coupled. In addition, as discussed above, the upper pressure sleeve 86 can be manipulated by lower piston 74 with gas flow above the lower piston 74, or by the gas in gap 92, and the punch core ring 66 can be manipulated by upper piston 52 or gas flow above the upper piston 52 or by the gas in gap 92. The movements by gas flow can be cumulative or in counteraction to the movement by the rams 18, 42.

The die holder 16 is coupled to several tooling components from radially inward to radially outward: die core 106 having sloped upper prong 112 located in opposed relationship to punch core 26 and punch core ring 66, die core ring 108 concentrically disposed around the die core 106 located in opposed relationship to the upper pressure pad 86, lower pressure sleeve 110 concentrically disposed around the die core ring 108 located in opposed relationship to the punch shell 94 and cutedge 102 with sharpened edge 141 located radially outward from the lower pressure sleeve 110. As discussed above, gas flow may urge certain toolings other than the cutedge 102 in an upward axial direction. Note that FIGS. 1–9 depict one radial cross section of the toolings of the doming press assembly 10, and that each of the tools depicted extend from the page in a generally circular matter in front of, behind and to the side of the page. Alternatively, such toolings could extend from the page in alternative geometric shapes for the manufacture of square, rectangular, oblong, elliptical or pear-shaped can ends.

As shown in FIG. 1, rams 18, 42 are moving axially downward towards the die core 16 and the punch shell 94 blanks the material M against the cutedge 102. The material M is held secure between the upper pressure sleeve 86 and the die core ring 108. The upper pressure sleeve 86 and the die core ring 108 serve the function of holding the material M secure for much of the can end forming process.

Figure 2:
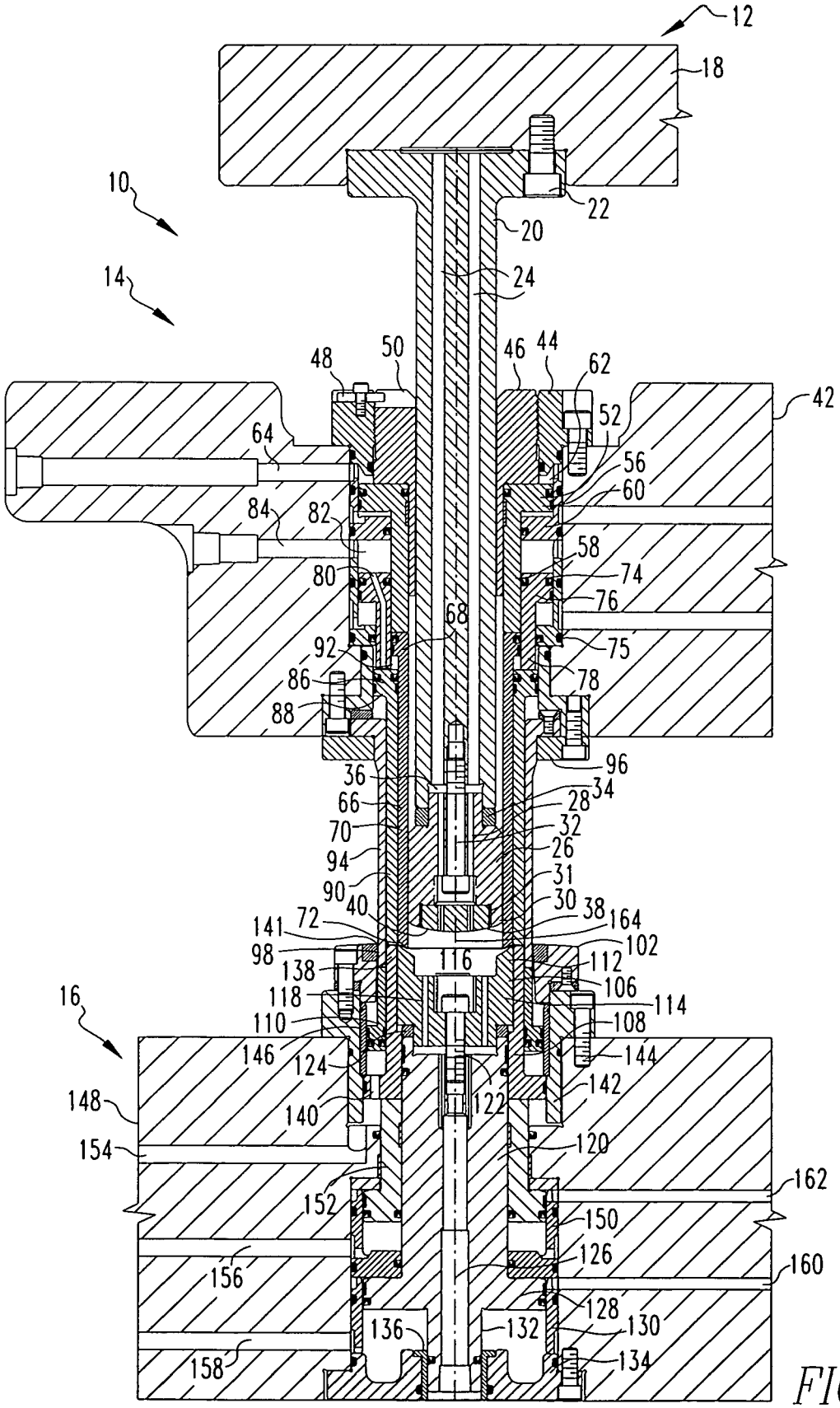
FIG. 2 is cross-sectional view of a double action doming press assembly showing a punch shell wiping material M over a die core ring to form a first surface connected to a second surface, an upper pressure sleeve cooperating with the die core ring to hold material M therebetween and a punch core ring beginning to draw or stretch material M which is located radially inwardly from a juncture of the first surface and the second surface and radially outwardly from an axis that passes through the center of the second surface.

Moving to FIG. 2, rams 18, 42 continue their axially downward decent towards the die core 16 and the punch shell 94 wipes material M over the die core ring 108 to form a first surface connected to a second surface in the material M which looks like a cup or hat whereby the downward decent of the punch shell 94 overcomes gas pressure beneath the lower pressure sleeve 110 and pushes the lower pressure sleeve 110 downward. The upper pressure sleeve 86 cooperates with the die core ring 108 to hold material M therebetween at the radially outward area of the second surface. The die core ring 108 pushes the upper pressure sleeve 86 upward which correspondingly pushes the lower piston 74 upward as well overcoming gas pressure above lower piston 74. The punch core ring 66 with its beveled end 72 begins to draw or stretch material M which is located radially inwardly from the juncture of the first surface and the second surface of the cup and radially outwardly from an axis 164 that passes through the center of the second surface of the material M. Gas pressure in gap 92 acts to selectively axially retract the punch core ring 66 in a controlled manner thereby avoiding overly strain hardening the material M while the punch core ring 66 draws or stretches the material M. Strain hardening creates wrinkles or tears in the material. Contact between the punch core ring 66 and the material M and/or gas in gap 92 pushes upper piston 52 upward as well overcoming gas pressure above upper piston 52.

Figure 3:
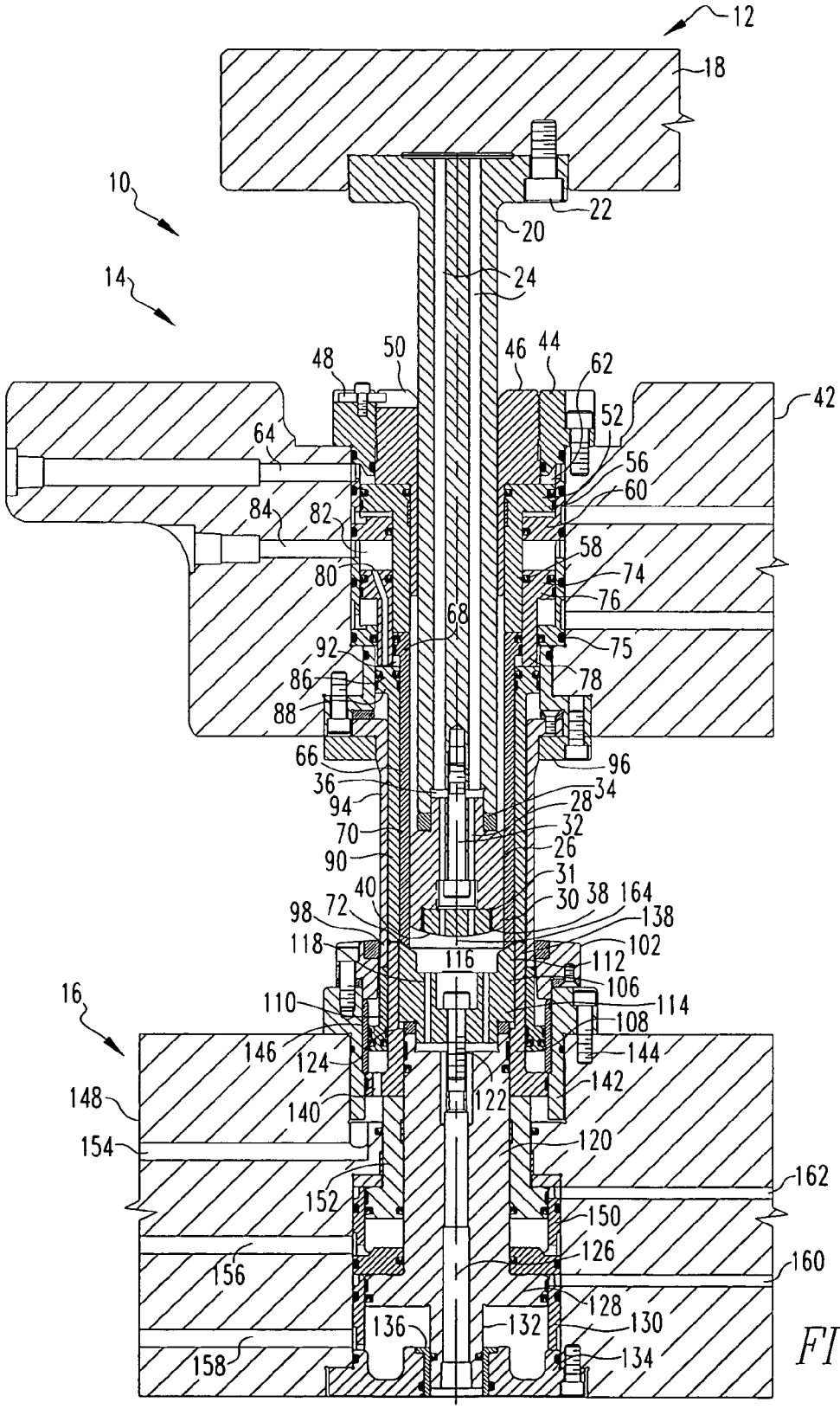
FIG. 3 is a cross-sectional view of a double action doming press assembly showing the upper pressure sleeve cooperating with the die core ring to hold material M therebetween, the punch core ring drawing or stretching material M which is located radially inwardly from the juncture of the first surface and the second surface and radially outwardly from the axis that passes through the center of the second surface and the punch core ring cooperating with a die core to hold the material M formed therebetween.

Moving to FIG. 3, rams 18, 42 continue their axially downward decent towards the die core 16 and the upper pressure sleeve 86 continues to cooperate with the die core ring 108 to hold material M therebetween at the radially outward area of the second surface. The die core ring 108 pushes the upper pressure sleeve 86 upward which correspondingly pushes the lower piston 74 upward as well overcoming gas pressure above lower piston 74. The punch core ring 66 continues to draw or stretch the material M which is located radially inwardly from the juncture of the first surface and the second surface and radially outwardly from the axis 164 until the material M is held between complementarily sloped or angled surfaces of the punch core ring 66 and the die core 106 which prevents the material M from being further drawn or stretched by the punch core ring 66 thereby substantially reducing the possibility of creating wrinkles in the material M located in this area. Certain prior art doming apparatuses that utilize a single punch core without a punch core ring suffer from the limitation of drawing or forming a dome in a can end in an uncontrolled manner which results in excessive strain hardening of the material which creates wrinkles or tears in the material. In the present invention, holding the material M between complementarily sloped or angled surfaces of the punch core ring 66 and the die core 106 prevents uncontrolled dome formation and controls the amount of drawing or stretching in the material M located radially inwardly from the juncture of the first surface and the second surface and radially outwardly from the axis 164 and controls the amount of drawing or stretching that occurs in this area because the punch core ring 66 will only draw the material M a preselected distance until the punch core ring 66 and the die core 106 hold the material M therebetween in a pressure relationship.

Figure 4:
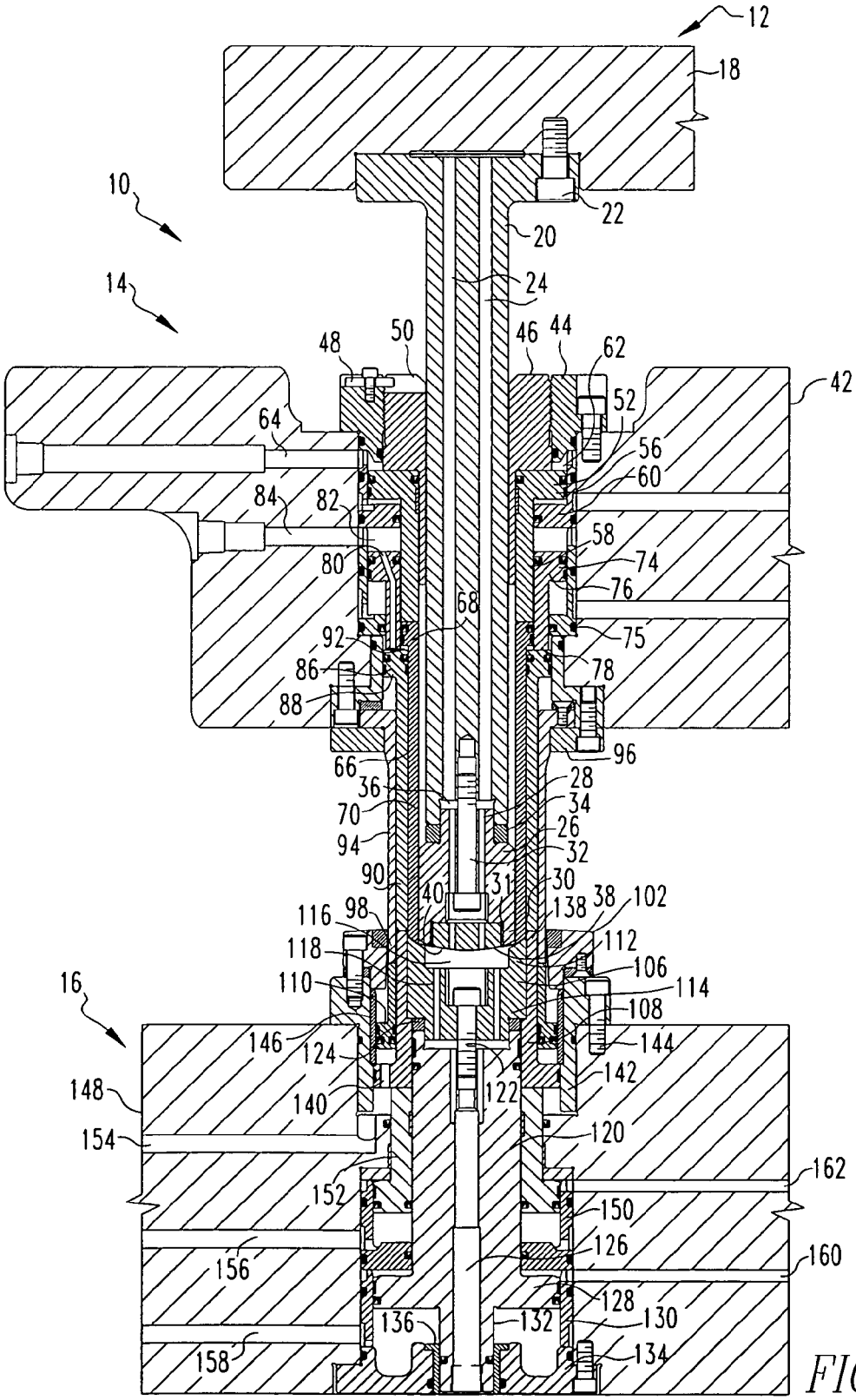
FIG. 4 is a cross-sectional view of a double action doming press assembly showing the upper pressure sleeve cooperating with the die core ring to hold material M therebetween, the punch core ring cooperating with the die core to hold the material M formed therebetween and a punch core beginning to dome, draw or stretch material M located radially inwardly from the material M drawn or stretched by the punch core ring.

Moving to FIG. 4, rams 18, 42 continue their axially downward decent towards the die core 16 and the upper pressure sleeve 86 continues to cooperate with the die core ring 108 to hold material M therebetween at the radially outward area of the second surface. The die core ring 108 pushes the upper pressure sleeve 86 upward which correspondingly pushes the lower piston 74 upward as well overcoming gas pressure above lower piston 74. The punch core ring 66 continues to cooperate with the die core 106 to hold the material M formed therebetween. The punch core ring 66 begins to push the die core 106 and die core riser 120 downward overcoming gas pressure beneath radial shelf 128. Here, a punch core 26 begins to dome, draw and/or stretch material M located radially inwardly from the material M drawn or stretched by the punch core ring 66.

Figure 5:
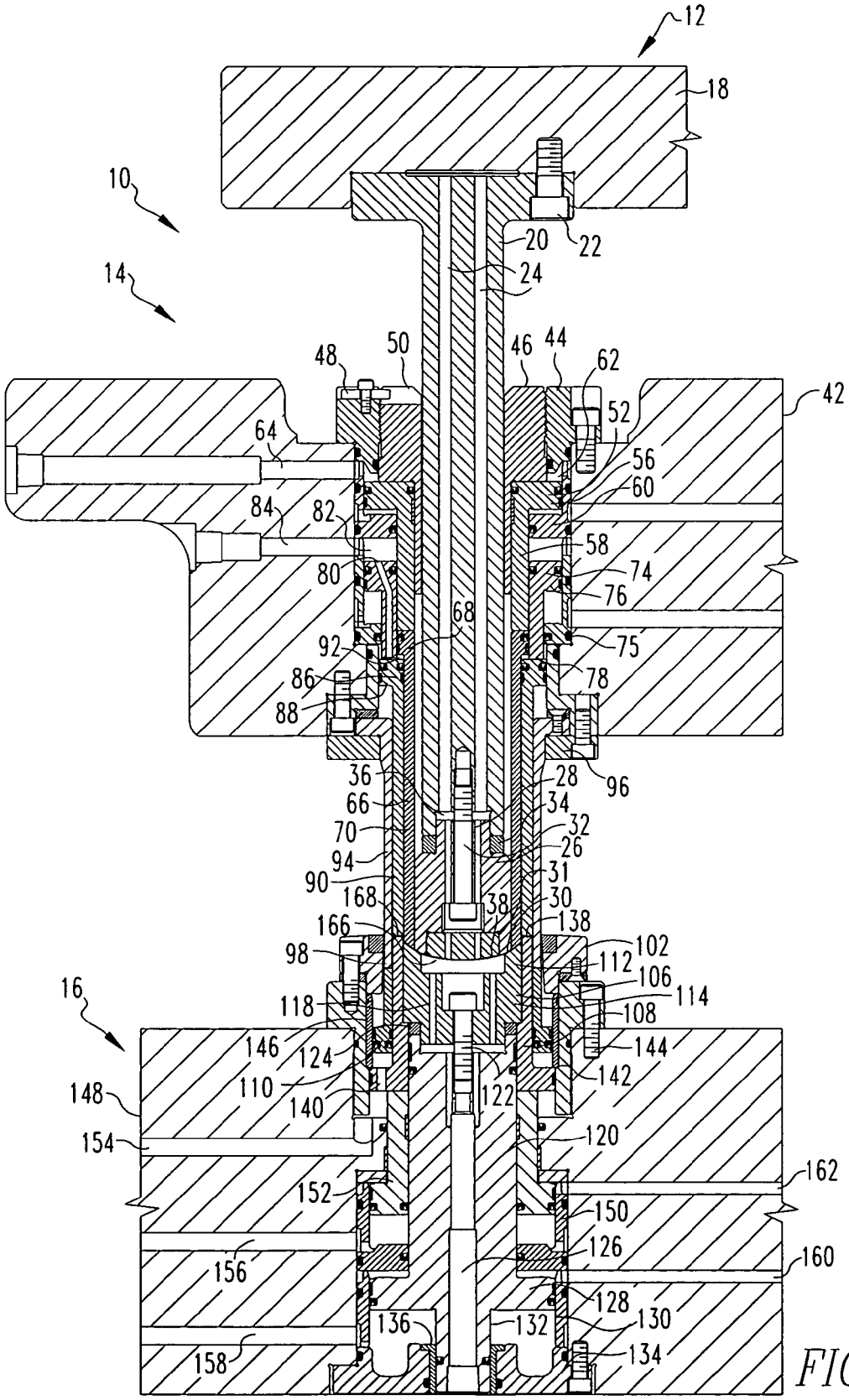
FIG. 5 is a cross-sectional view of a double action doming press assembly showing the upper pressure sleeve cooperating with the die core ring to hold material M therebetween, the punch core ring cooperating with the die core to hold the material M formed therebetween and the punch core doming, drawing or stretching material M located radially inwardly from the material M drawn or stretched by the punch core ring.

Moving to FIG. 5, ram 18 continues its axially downward decent towards the die core 16, ram 42 reaches bottom dead center of the doming press assembly 10 and the upper pressure sleeve 86 continues to cooperate with the die core ring 108 to hold material M therebetween at the radially outward area of the second surface. In this FIG. 5, gas pressure begins to build up above lower piston 74 thereby pushing lower piston 74 down. The punch core ring 66 continues to cooperate with the die core 106 to hold the material M formed therebetween. Punch core 26 continues to dome, draw and/or stretch material M located radially inwardly from the material M drawn or stretched by the punch core ring 66 until the material M is fully formed into a can end with a domed central panel disposed between the juncture of the first surface and the second surface on one side of the can end and the juncture of the first surface and the second surface at an opposite side of the can end wherein that juncture has the shape of an annular ridge 168 and the material M is held between complementarily sloped or angled surfaces of the punch core 26 and the die core 106 which prevents the material M from being further domed, drawn or stretched by the punch core 26 thereby substantially reducing the possibility of creating wrinkles in the material M located in this area. Certain prior art doming apparatuses that utilize a single punch core without a punch core ring suffer from the limitation of drawing or forming a dome in a can end in an uncontrolled manner which results in excessive strain hardening of the material which creates wrinkles or tears in the material. In the present invention, holding the material M between the complementarily sloped or angled surfaces of the punch core 26 and the die core 106 prevents uncontrolled dome formation and controls the amount of doming, drawing or stretching in the material M located radially inwardly from the material M drawn or stretched by the punch core ring 66 and controls the amount of doming, drawing or stretching that occurs in this area because the punch core 26 will only draw the material M a preselected distance until the punch core 26 and the die core 106 hold the material M therebetween in a pressure relationship. The punch core ring 66 and the punch core 26 push the die core 106 and die core riser 120 downward overcoming gas pressure beneath radial shelf 128.

Figure 6:
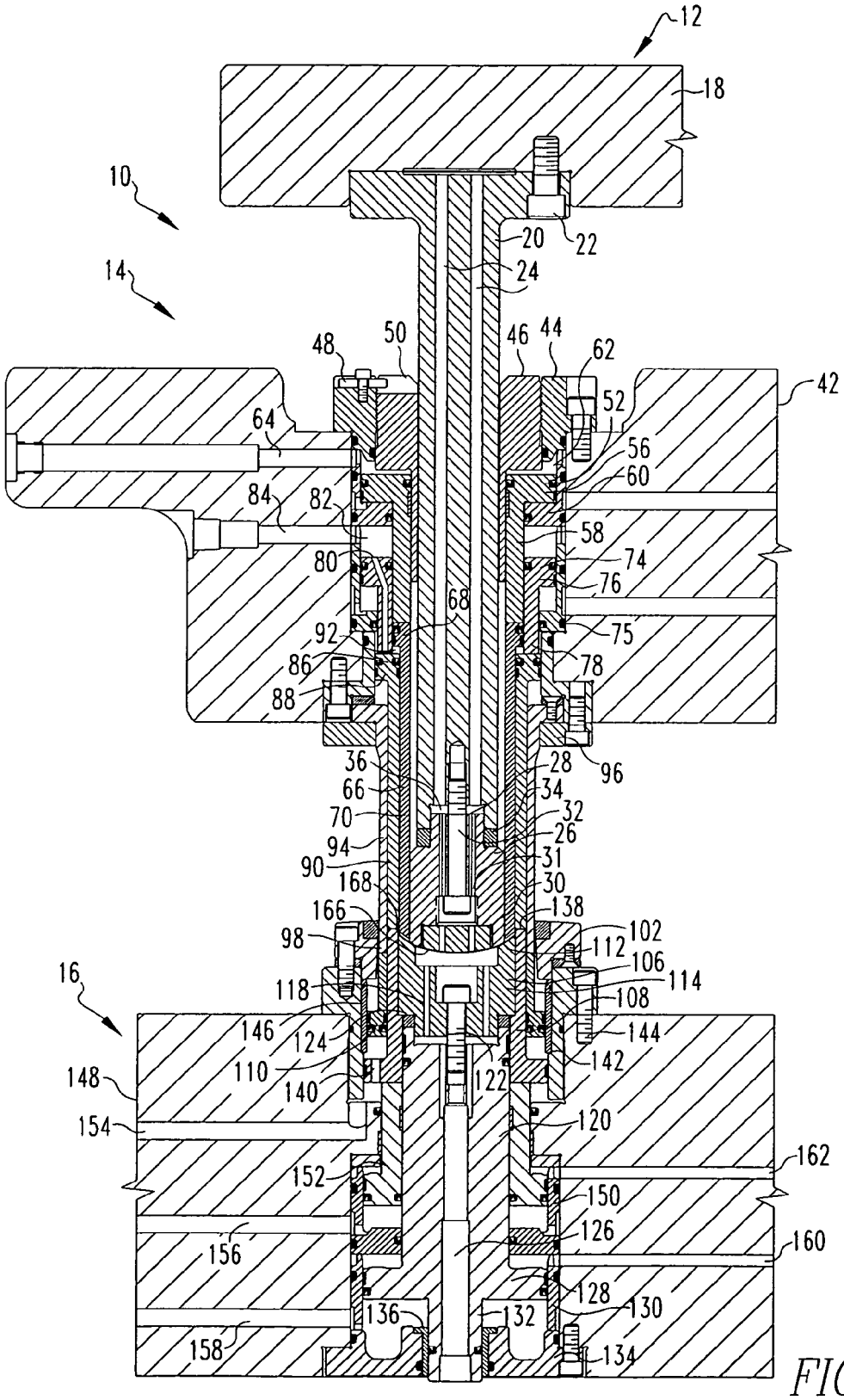
FIG. 6 is a cross-sectional view of a double action doming press assembly showing the upper pressure sleeve cooperating with the die core ring to hold material M therebetween, the punch core ring moving axially away from the material M and the punch core cooperating with the die core to hold the material M formed therebetween.

Moving to FIG. 6, ram 18 continues its axially downward decent towards the die core 16, ram 42 begins its axially upward ascent away from the die core 16 and the upper pressure sleeve 86 continues to cooperate with the die core ring 108 to hold material M therebetween at the radially outward area of the second surface. In this FIG. 6, gas pressure builds up above lower piston 74 thereby pushing lower piston 74 down which pushes the upper pressure sleeve 86 down and, correspondingly, the die core ring 108 and piston 152 beneath the die core ring 108 downward overcoming the gas pressure beneath the piston 152. Here, pressurized gas supplied to gap 92 through bores 80, 84 push the punch core ring 66 axially upward away from the material M. The punch core 26 continues to cooperate with the die core 106 to hold material M that was domed therebetween without deepening the depth of the dome that has been formed thereby avoiding excessive strain hardening of the material M which creates wrinkles or tears in material M. The punch core 26 pushes the die core 106 and die core riser 120 downward overcoming gas pressure beneath radial shelf 128.

Figure 7:
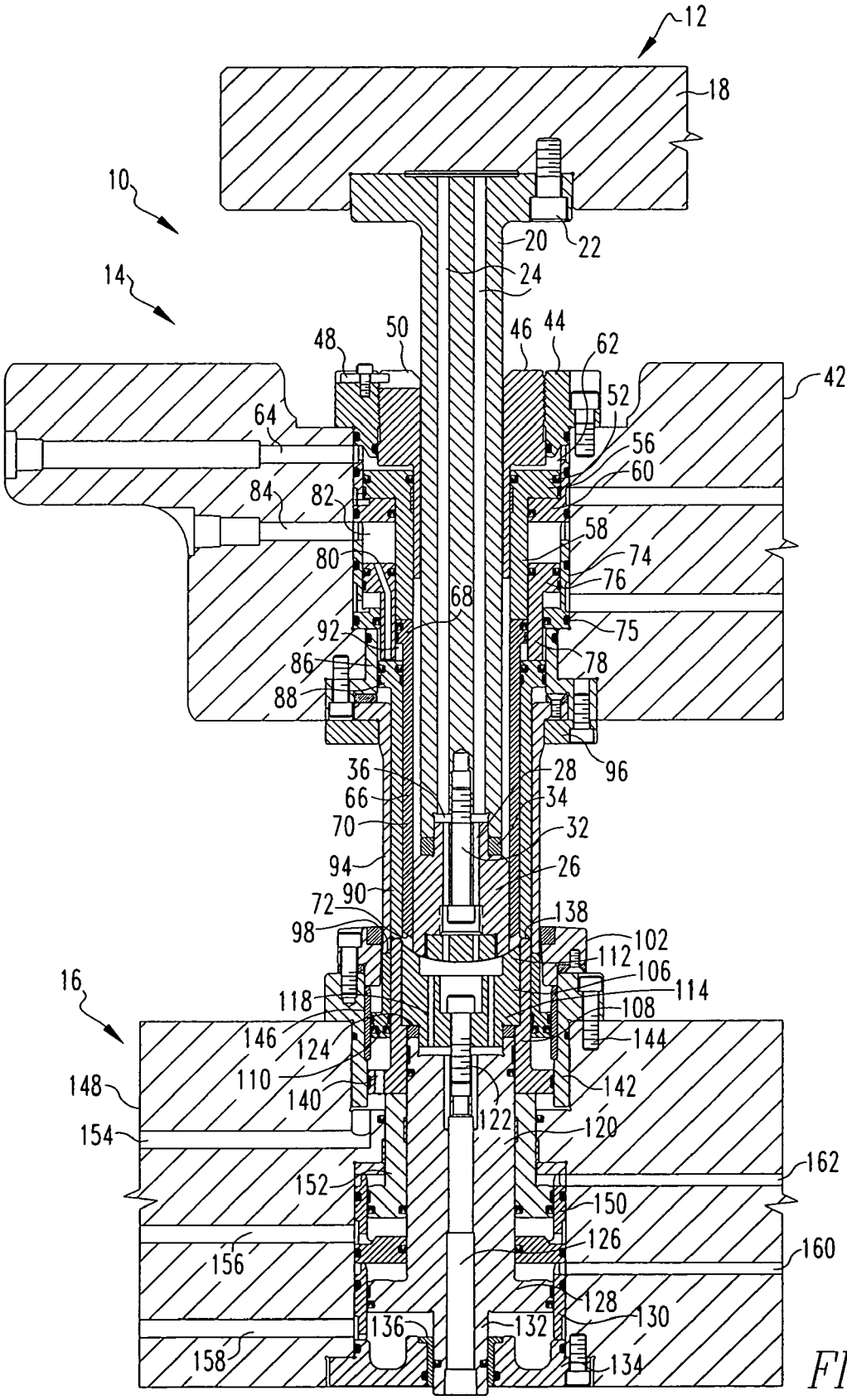
FIG. 7 is a cross-sectional view of a double action doming press assembly showing the upper pressure sleeve cooperating with the die core ring to hold material M therebetween, the punch core ring moving axially away from the material M and the punch core cooperating with the die core to hold the material M formed therebetween.

Moving to FIG. 7, ram 18 reaches bottom dead center of the doming press assembly 10, ram 42 continues its axially upward ascent away from the die core 16 and the upper pressure sleeve 86 continues to cooperate with the die core ring 108 to hold material M therebetween at the radially outward area of the second surface. In this FIG. 7, gas pressure builds up above lower piston 74 thereby pushing lower piston 74 down which pushes the upper pressure sleeve 86 down and, correspondingly, the die core ring 108 and piston 152 beneath the die core ring 108 downward overcoming the gas pressure beneath the piston 152. Here, pressurized gas supplied to gap 92 through bores 80, 84 push the punch core ring 66 axially upward away from the material M as well. The punch core 26 continues to cooperate with the die core 106 to hold material M that was domed therebetween without deepening the depth of the dome that has been formed thereby avoiding excessive strain hardening of the material M which creates wrinkles or tears in material M. The punch core 26 pushes the die core 106 and die core riser 120 downward overcoming gas pressure beneath radial shelf 128.

Figure 8:
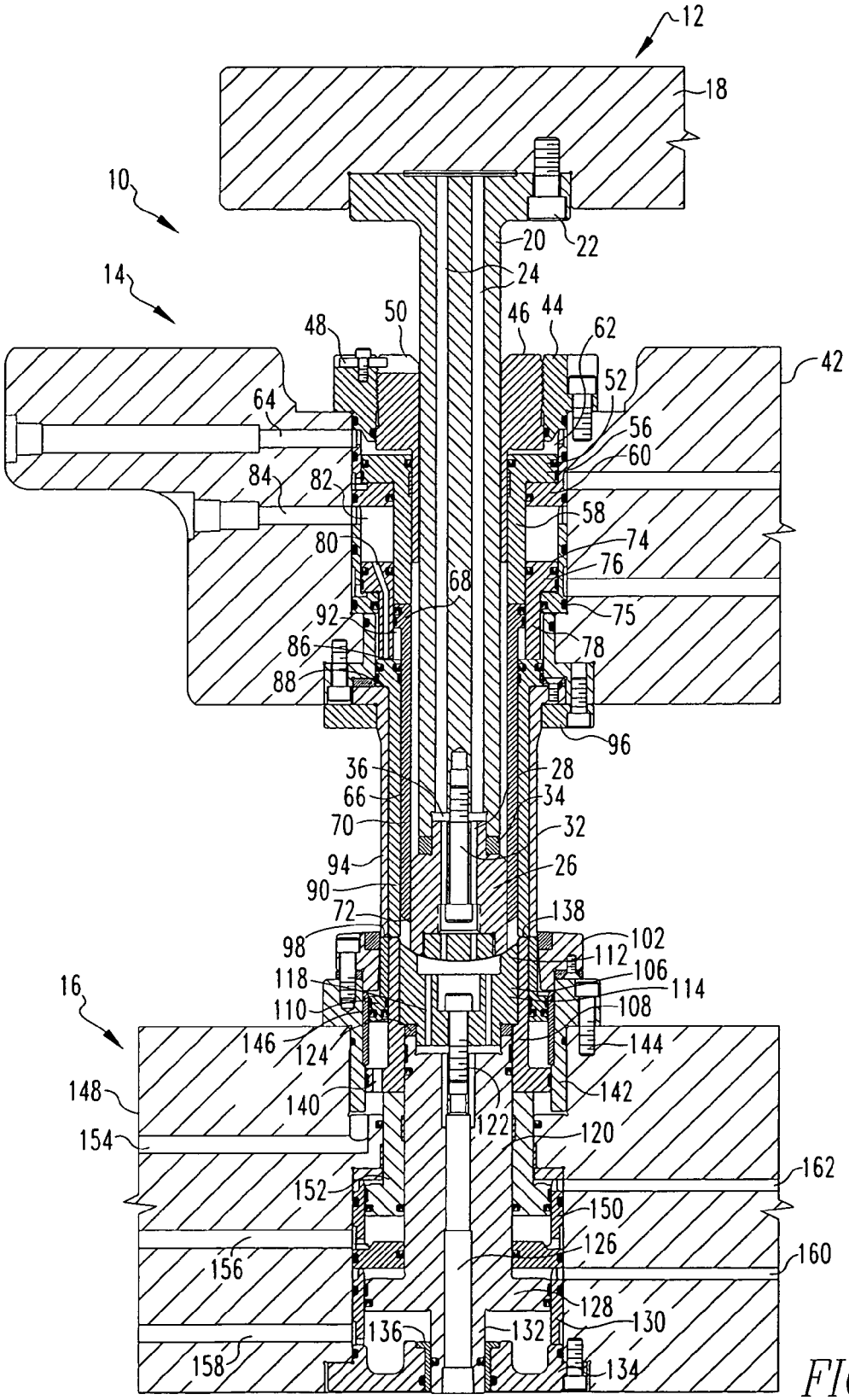
FIG. 8 is a cross-sectional view of a double action doming press assembly showing the upper pressure sleeve cooperating with the die core ring to hold material M therebetween, the punch core ring moving axially away from the material M and the punch core cooperating with the die core to hold the material M formed therebetween.

Moving to FIG. 8, ram 18 begins its axially upward ascent from the die core 16, ram 42 continues its axially upward ascent away from the die core 16 and the upper pressure sleeve 86 continues to cooperate with the die core ring 108 to hold material M therebetween at the radially outward area of the second surface. In this FIG. 8, gas pressure builds up above lower piston 74 thereby pushing lower piston 74 down which pushes the upper pressure sleeve 86 down and, correspondingly, the die core ring 108 and piston 152 beneath the die core ring 108 downward overcoming the gas pressure beneath the piston 152. Here, pressurized gas supplied to gap 92 through bores 80, 84 push the punch core ring 66 axially upward away from the material M as well. The punch core 26 continues to cooperate with the die core 106 to hold material M that was domed therebetween without deepening the depth of the dome that has been formed thereby avoiding excessive strain hardening of the material M which creates wrinkles or tears in material M. The die core 106 and die core riser 120 begin to push radially upward in response to gas supplied through bore 158 beneath radial shelf 128.

Figure 9:
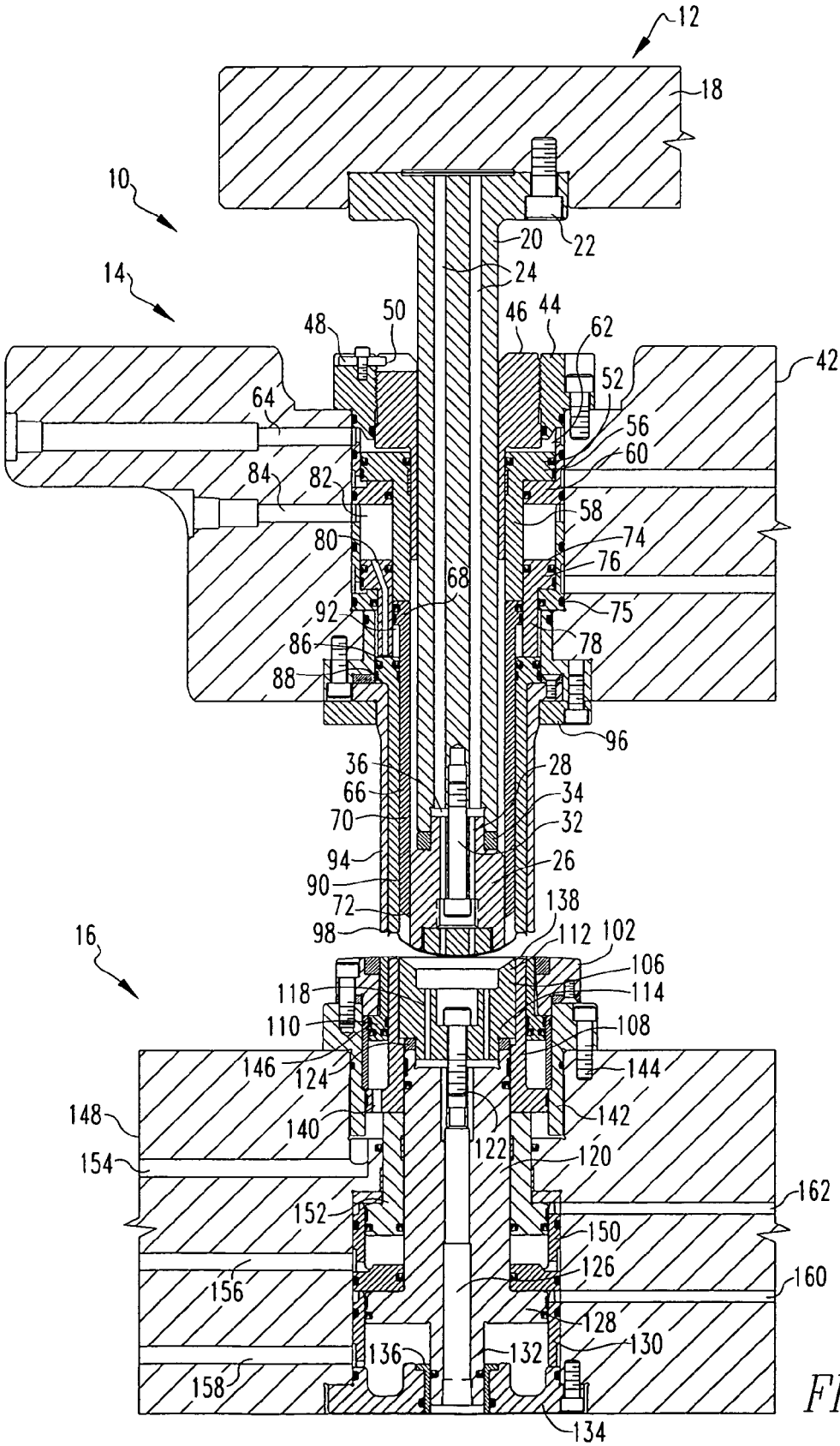
FIG. 9 is a cross-sectional view of a double action doming press assembly showing a domed can end after it has been formed.

Moving to FIG. 9, rams 18, 42 continue their axially upward ascent from the die core 16, and the domed can end of the present invention has been formed in a controlled manner by the process of the present invention. The can end may now be ejected from the doming press assembly 10. The can end may be ejected through gas flow through bores 24 and 28, pushing the can end off the doming press assembly 10 and onto a neighboring conveyer belt. Now, the process of forming the domed can end with the doming press assembly 10 of the present invention may be repeated.

In an alternate embodiment of the invention where certain of the wear tools could be utilized to form a dome in the bottom of a can body, one of ordinary skill in the art would recognize that the punch shell 94, cut edge 102 and lower pressure sleeve 110 components of the present invention are not be needed since a dome could be formed in a can body that has already been drawn and/or ironed and has an annular ridge at the juncture of a first surface and a second surface. As such, the description provided above for the punch core 26, the punch core ring 66 and the upper pressure sleeve 86 acting in cooperation with the die core 106 and the die core ring 108 for forming a domed can end could be substantially similar to the process for forming a dome in a can body as outlined above and in FIGS. 1–9 with the omission of the description provided above directed to the punch shell 94, cut edge 102 and lower pressure sleeve 110. For the purpose of simplifying the patent specification, that process will not be provided herein it being noted that a punch core, a punch core ring and a upper pressure sleeve acting in cooperation with a die core and a die core ring could be used to dome a can body with a substantially similar process to that depicted in FIGS. 1–9 described above with the omission of the description provided above directed to the punch shell 94, cut edge 102 and lower pressure sleeve 110.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A method for forming a domed can end from material in a doming press assembly, in an apparatus with one or a multiplicity of doming press assemblies, comprising the steps of:

i) moving the material into the assembly between a set of upper toolings and a set of lower toolings;

ii) providing the material with a first surface connected to a second surface;

iii) holding the material at a radially outward area of the second surface;

iv) drawing or stretching the material located radially inwardly from the connection of the first surface and the second surface and radially outwardly from an axis that passes through a center of the second surface of the material;

v) holding the drawn or stretched material at the location of the material that was drawn or stretched in step iv) in a pressure relationship;

vi) drawing, stretching or doming the material located radially inwardly from the location of the material drawn or stretched in step iv); and vii) holding the drawn, stretched or domed material at the location of the material that was drawn, stretched or domed in step vi) in a pressure relationship, and wherein the upper toolings include a lower piston located above an upper pressure sleeve and radially outward from a punch core ring wherein the lower piston has a bore and the lower piston, punch core ring and upper pressure sleeve define a gap to which pressurized gas may be supplied through the bore to selectively axially actuate the punch core ring.

2. The method of claim 1, further comprising the step of blanking the material to form a blank.

3. The method of claim 1, further comprising the step of wiping the material over a die core ring with a punch shell.

4. The method of claim 1, further comprising the step of forming an annular ridge at the connection of the first surface and the second surface.

5. The method of claim 1 wherein the upper toolings comprise a punch core, a punch core ring radially outward the punch core and an upper pressure sleeve radially outward the punch core ring and the lower toolings comprise a die core and a die core ring radially outward the die core.

6. The method of claim 1 wherein the upper toolings comprise a punch core, a punch core ring radially outward the punch core, an upper pressure sleeve radially outward the punch core ring and a punch shell radially outward the upper pressure sleeve and the lower toolings comprise a die core, a die core ring radially outward the die core, a lower pressure sleeve radially outward the die core ring and a cut edge radially outward the lower pressure sleeve.

7. The method of claim 1 wherein the apparatus is a double action press.

8. An apparatus for forming a domed can end from material in a doming press assembly, the apparatus comprising:

a punch core;

a punch core ring concentrically disposed around the punch core and located radially outward from the punch core;

an upper pressure sleeve concentrically disposed around the punch core ring and located radially outward from the punch core ring;

a die core located in opposed relationship to the punch core and the punch core ring;

a die core ring concentrically disposed around the die core and located radially outward from the die core in opposed relationship to the upper pressure sleeve; and a lower piston located above the upper pressure sleeve and radially outward from the punch core ring, wherein the upper pressure sleeve and the die core ring are structured to hold material having a first surface and a second surface therebetween at a radially outward extent of the second surface, wherein the punch core ring is selectively axially actuable and is structured to draw or stretch the material located radially inwardly from the connection of the first surface and the second surface and radially outwardly from an axis that passes through a center of the second surface of the material, wherein the punch core ring and the die core ring are structured to hold the material located radially inwardly from the connection of the first surface and the second surface and radially outwardly from the axis, wherein the punch core is structured to draw, stretch or dome the material located radially inwardly from the material that would be drawn or stretched by the punch core ring, wherein the punch core and the die core are structured to hold the material located radially inwardly from the material that would be drawn or stretched by the punch core ring, and wherein the lower piston has a bore and the lower piston, punch core ring and upper pressure sleeve define a gap to which pressurized gas may be supplied through the bore to selectively axially actuate the punch core ring.

9. The apparatus of claim 8 further comprising a punch shell concentrically disposed around the upper pressure sleeve and located radially outward from the upper pressure sleeve, a lower pressure sleeve concentrically disposed around the die core ring and located radially outward from the die core ring in opposed relationship to the punch shell and a cut edge located radially outward from the lower pressure sleeve.

10. The apparatus of claim 8 wherein the apparatus is a double action press.

11. An apparatus for forming a can end from material in a press assembly, the apparatus comprising:

a punch core;

a punch core ring concentrically disposed around the punch core and located radially outward from the punch core;

an upper pressure sleeve concentrically disposed around the punch core ring and located radially outward from the punch core ring;

a die core located in opposed relationship to the punch core and the punch core ring;

a die core ring concentrically disposed around the die core and located radially outward from the die core in opposed relationship to the upper pressure sleeve; and a lower piston located above the upper pressure sleeve and radially outward from the punch core ring, and wherein the lower piston has a bore and the lower piston, punch core ring and upper pressure sleeve define a gap to which pressurized gas may be supplied through the bore to selectively axially actuate the punch core ring.

12. The apparatus of claim 11 wherein the upper pressure sleeve and the die core ring are structured to hold material having a first surface and a second surface therebetween at a radially outward extent of the second surface, wherein the punch core ring is selectively axially actuable and is structured to draw or stretch the material located radially inwardly from the connection of the first surface and the second surface and radially outwardly from an axis that passes through a center of the second surface of the material, wherein the punch core ring and the die core ring are structured to hold the material located radially inwardly from the connection of the first surface and the second surface and radially outwardly from the axis, wherein the punch core is structured to draw, stretch or dome the material located radially inwardly from the material that would be drawn or stretched by the punch core ring, and wherein the punch core and the die core are structured to hold the material located radially inwardly from the material that would be drawn or stretched by the punch core ring.

13. The apparatus of claim 11 further comprising a punch shell concentrically disposed around the upper pressure sleeve and located radially outward from the upper pressure sleeve, a lower pressure sleeve concentrically disposed around the die core ring and located radially outward from the die core ring in opposed relationship to the punch shell and a cut edge located radially outward from the lower pressure sleeve.

14. The apparatus of claim 11 wherein the apparatus is a double action press.

15. An apparatus for forming a can end from material in a press assembly, the apparatus comprising:

a punch core ring;

an upper pressure sleeve concentrically disposed around the punch core ring and located radially outward from the punch core ring; and a lower piston located above the upper pressure sleeve and radially outward from the punch core ring, and wherein the lower piston has a bore and the lower piston, punch core ring and upper pressure sleeve define a gap to which pressurized gas may be supplied through the bore to selectively actuate the punch core ring.

16. The apparatus of claim 15 wherein the upper pressure sleeve is structured to hold material with a die core ring, the material having a first surface and a second surface therebetween at a radially outward extent of the second surface, wherein the punch core ring is selectively axially actuable and is structured to draw or stretch the material located radially inwardly from the connection of the first surface and the second surface and radially outwardly from an axis that passes through a center of the second surface of the material, wherein the punch core ring and the die core ring are structured to hold the material located radially inwardly from the connection of the first surface and the second surface and radially outwardly from the axis, and wherein a punch core is structured to draw, stretch or dome the material located radially inwardly from the material that would be drawn or stretched by the punch core ring, and wherein the punch core and a die core are structured to hold the material located radially inwardly from the material that would be drawn or stretched by the punch core ring.

17. The apparatus of claim 16 further comprising a punch shell concentrically disposed around the upper pressure sleeve and located radially outward from the upper pressure sleeve, a lower pressure sleeve concentrically disposed around the die core ring and located radially outward from the die core ring in opposed relationship to the punch shell and a cut edge located radially outward from the lower pressure sleeve.

* * * * *